US007328750B2

(12) United States Patent
Swor et al.

(10) Patent No.: US 7,328,750 B2
(45) Date of Patent: Feb. 12, 2008

(54) SEALING PLUG AND METHOD FOR REMOVING SAME FROM A WELL

(75) Inventors: Loren C. Swor, Duncan, OK (US); Donald Smith, Wilson, OK (US); David Armstrong, Tulsa, OK (US); Brian K. Wilkinson, Duncan, OK (US); Phillip M Starr, Duncan, OK (US); Stephen E. Tilghman, Marlow, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 263 days.

(21) Appl. No.: 11/183,017

(22) Filed: Jul. 15, 2005

(65) Prior Publication Data

US 2006/0021748 A1 Feb. 2, 2006

Related U.S. Application Data

(63) Continuation of application No. 10/435,642, filed on May 9, 2003, now Pat. No. 6,926,086.

(51) Int. Cl.
*E21B 33/12* (2006.01)

(52) U.S. Cl. ..... 166/376; 166/387; 166/55

(58) Field of Classification Search ..... 166/376, 166/387, 118, 55

See application file for complete search history.

(56) References Cited

U.S. PATENT DOCUMENTS 4,099,464 A 7/1978 Cross et al.
4,790,385 A 12/1988 McClure et al.
4,834,184 A 5/1989 Streich et al.
5,129,322 A 7/1992 Christopher et al.
5,188,183 A 2/1993 Hopmann et al.
5,224,540 A 7/1993 Streich et al.
5,271,468 A 12/1993 Streich et al.
5,479,986 A 1/1996 Gano et al.
5,558,153 A 9/1996 Holcombe et al.
5,765,641 A 6/1998 Shy et al.
5,791,821 A 8/1998 Kiesler
6,016,753 A 1/2000 Glenn et al.
6,026,903 A 2/2000 Shy et al.
6,095,247 A 8/2000 Streich et al.
6,102,117 A 8/2000 Swor et al.
6,220,350 B1 4/2001 Brothers et al.
6,237,688 B1 5/2001 Burleson et al.
6,318,460 B1 11/2001 Swor et al.
6,334,488 B1 1/2002 Freiheit
6,354,372 B1 3/2002 Carisella et al.

(Continued)

OTHER PUBLICATIONS

U.S. Appl. No. 10/765,509, filed Jan. 27, 2004, Starr et al.

(Continued)

*Primary Examiner*—William P Neuder
(74) *Attorney, Agent, or Firm*—John W. Wustenberg; Conley Rose, P.C.

(57) ABSTRACT

A tool and a method for sealing a casing or a wellbore according to which a device is supported on a mandrel and expands into engagement with the casing or the wellbore. An explosive cutter is also supported on the mandrel and is adapted to explode to cut the mandrel and the device and release the engagement.

23 Claims, 3 Drawing Sheets

U.S. PATENT DOCUMENTS

| | | | | |
|---|---|---|---|---|
| 6,378,606 | B1 | 4/2002 | Swor et al. | |
| 6,394,180 | B1 | 5/2002 | Berscheidt et al. | |
| 6,397,950 | B1 | 6/2002 | Streich et al. | |
| 6,481,497 | B2 | 11/2002 | Swor et al. | |
| 6,491,116 | B2 | 12/2002 | Berscheidt et al. | |
| 6,536,349 | B2 | 3/2003 | Patterson et al. | |
| 6,666,275 | B2 | 12/2003 | Neal et al. | |
| 6,792,866 | B2 | 9/2004 | Grattan | |
| 7,210,533 | B2 * | 5/2007 | Starr et al. | 166/376 |
| 2002/0088616 | A1 | 7/2002 | Swor et al. | |
| 2003/0024712 | A1 | 2/2003 | Neal et al. | |
| 2003/0168214 | A1 | 9/2003 | Sollesness | |
| 2004/0069485 | A1 | 4/2004 | Ringgenberg et al. | |
| 2004/0221993 | A1 | 11/2004 | Patterson et al. | |

OTHER PUBLICATIONS

U.S. Appl. No. 10/435,642, filed May 9, 2003, Swor et al.

* cited by examiner

SEALING PLUG AND METHOD FOR REMOVING SAME FROM A WELL

CROSS-REFERENCE TO RELATED APPLICATIONS

This application is a continuation-in-part of U.S. patent application Ser. No. 10/435,642 filed May 9, 2003 now U.S. Pat. No. 6,926,086, the entire disclosure of which is incorporated herein by reference in its entirety.

BACKGROUND

This application relates to a plug for sealing a well in oil and gas recovery operations, and a method of removing the plug from the well.

After a well is put into production, a wellhead is usually placed over the well at the ground surface and a closure device, such as a sealing cap, or the like, is provided at the wellhead to prevent the flow of production fluid from the well during certain circumstances. Sometimes, under these conditions, the closure device must be removed for replacement, repair, etc., which creates a risk that some production fluid from the well may flow out from the upper end of the well.

To overcome this, a sealing plug, also called a bridge plug or barrier plug, is usually inserted in the well and activated to plug, or seal, the well and prevent any escape of the production fluid out the top of the well. However, when it is desired to recap the well, a rig must be brought to the well and used to drill-out the sealing plug, or pull the plug from the well. Both of these techniques require sophisticated equipment, are labor intensive, and therefore are expensive.

Therefore, what is needed is a sealing plug of the above type which can be placed in the well to seal off the flow of production fluid as discussed above and yet can be removed in a relatively simple and inexpensive manner.

DETAILED DESCRIPTION

Figure 1:
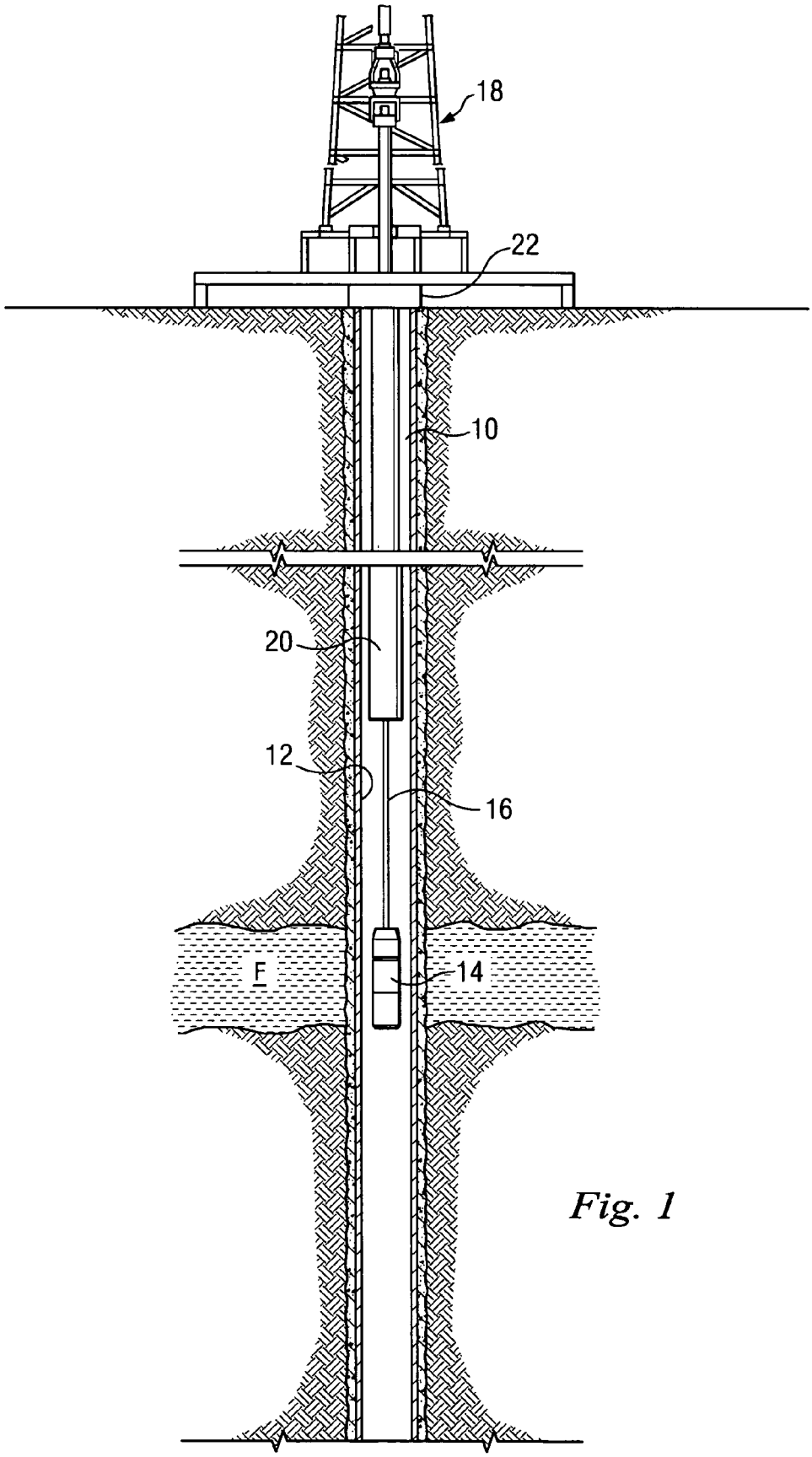
FIG. 1 is a schematic/elevational/sectional view of an oil and gas recovery operation including a tool according to an embodiment of the invention.

Referring to FIG. 1, the reference numeral 10 refers to a wellbore penetrating a subterranean ground formation F for the purpose of recovering hydrocarbon fluids from the formation. The wellbore 10 could be an openhole completion or a cased completion, and in the latter case a casing 12 would be cemented in the wellbore 10 in a conventional manner.

A sealing plug, or sealing tool, 14 is disposed in the wellbore 10 at a predetermined depth and is lowered to this position by a work string 16, in the form of coiled tubing, jointed tubing, wire line, or the like, which is connected to the upper end of the plug 14. The plug 14 is shown generally in FIG. 1 and will be described in detail later.

The work string 16 extends from a rig 18 located above ground and extending over the wellbore 10. The rig 18 is conventional and, as such, includes a support structure, a motor driven winch, or the like, and other associated equipment for lowering plug 14, via the string 16, into the wellbore 10.

The string 16 extends through a wellhead 22 that is positioned over the upper end of the wellbore 10 and the casing 12 at the rig 18. The wellhead 22 is conventional and, as such, includes a closure device (not shown), such as a cap, or the like, for preventing the flow of production fluid from the formation F and through the casing 12, while permitting movement of the string 16, in a conventional manner.

A string of production tubing 20, having a diameter greater than that of the tool 14, but less than that of the casing 12, is installed in the wellbore 10 and extends from the ground surface to a predetermined depth in the casing 12 below the lower end of the casing 12.

Figure 2:
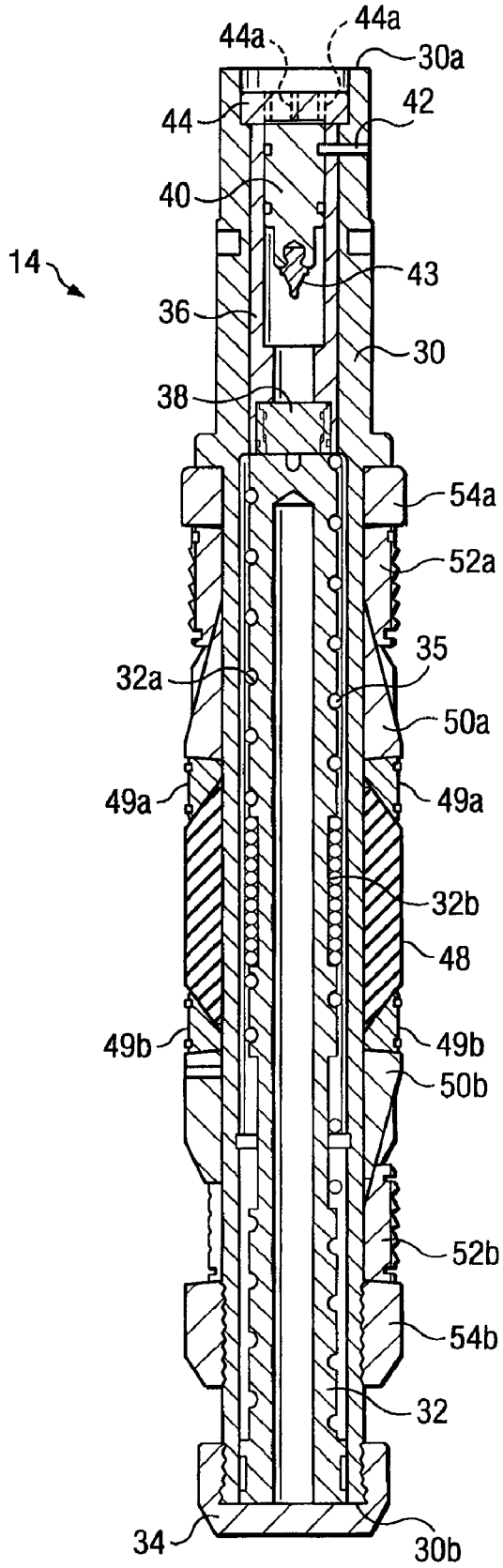
FIG. 2 is an enlarged, sectional view of the tool of FIG. 1.

With reference to FIG. 2, the plug 14 includes a mandrel 30 having an upper end 30*a* and a lower end 30*b*, between which a continuous bore extends. A tubular liner 32 is disposed in the bore of the mandrel 30, with the lower end of the liner 32 extending flush with the lower end 30*b* of the mandrel 30. A cap 34 extends over the lower end 30*b* of the mandrel 30 and the corresponding end of the liner 32 to retain the liner 32 in the mandrel 30.

A series of axially-spaced circumferential grooves 32*a* are formed in the outer surface of the liner 32 which receive a detonation cord 35. The cord 35 is wrapped around the liner 32 and extends in the grooves 32*a*, and also is more tightly wrapped in an enlarged recess 32*b* formed in the liner 32. The cord 35 can be of a conventional design and, as such, contains an explosive, which explodes when detonated.

A sleeve 36 is disposed in the upper portion of the bore of the mandrel 30 with the lower end of the sleeve 36 abutting the upper end of the liner 32. The upper end of the sleeve 36 is spaced slightly from the upper end 30*a* of the mandrel 30.

A detonation initiator, or detonator, 38 is located in the lower portion of the sleeve 36 and its lower end extends flush with the other end of the sleeve 36 and abuts the upper end of the liner 32. The initiator 38 is conventional and, when activated in a manner to be described, detonates the cord 35, causing the explosive in the cord 35 to explode.

A piston 40 is provided in the sleeve 36 and is normally retained in the sleeve 36 by a series of shear pins, one of which is shown by the reference numeral 42. In the position of the piston 40 shown in FIG. 2, its upper end extends flush with the upper end of the sleeve 36. A firing pin 43 is mounted on the lower end portion of the piston 40, and, in this position of the piston 40, the firing pin 43 normally extends in a spaced relation to the initiator 38.

A cap 44, having a plurality of axially-extending through openings 44*a*, is disposed in a counterbore disposed in the upper end 30*a* of the mandrel 30 and abuts the corresponding ends of the sleeve 36 and the piston 40.

A compression-set, annular sealing element 48 extends around the mandrel 30 and is axially positioned between two sets of extrusion limiters 49*a* and 49*b*. A pair of wedges 50*a* and 50*b* extend between the extrusion limiters 49*a* and 49*b*, respectively, and two sets of slips 52*a* and 52*b*, respectively. The inner surfaces of the end portions of the slips 52*a* and 52*b* adjacent the wedges 50*a* and 50*b* are beveled so as to receive the corresponding tapered end portions of the wedges 50*a* and 50*b*. A mechanism for expanding and setting the sealing element 48 and the slips 52*a* and 52*b* includes a pair of axially-spaced ratchet shoes 54*a* and 54*b* that extend around the mandrel 30 and abut the corresponding ends of the slips 52*a* and 52*b*. Since the extrusion limiters 49*a* and 49*b*, the wedges 50*a* and 50*b*, the slips 52*a* and 52*b*, and the shoes 54*a* and 54*b* are conventional, they will not be described in further detail.

The sealing element 48 and the slips 52*a* and 52*b* are activated, or set, in a conventional manner by using a setting tool, or the like (not shown), to move the shoe 54*a* downwardly relative to the mandrel 30, as viewed in FIG. 2, and to move the shoe 54*b* upwardly relative to the mandrel 30. This places a compressive force on the assembly formed by the slips 52*a* and 52*b*, the wedges 50*a* and 50*b*, and the sealing element 48. As a result, the slips 52*a* and 52*b* are forced radially outwardly into a locking engagement with the inner wall of the casing 12, and the sealing element 48 expands radially outwardly into a sealing engagement with the inner wall. Thus, the plug 14 seals against any flow of production fluid from the formation F through the casing 12.

When the well is not in production, the above-mentioned closure device associated with the wellhead 22 (FIG. 1) is set to prevent any flow of production fluid from the formation F and through the casing 12 to the rig 18. However, if the closure device has to be removed for repair, replacement, or the like, the casing 12 must be sealed to prevent the production fluid flow. To this end, the plug 14 is lowered, via the string 16, to a desired depth in the casing 12, and the sealing element 48 and the slips 52*a* and 52*b* are activated in the manner discussed above so that the plug 14 seals the casing 12, all in the manner described above.

When it is desired to recap the well, the plug 14 is removed in the following manner. Fluid, such as water, from a source at the rig 18 (FIG. 1) is introduced into the upper end of the casing 12 and passes through the openings 44*a* in the cap 44, thus creating a pressure, or force, against the piston 40. When this force reaches a certain magnitude, the shear pins 42 break to allow the piston 40 to fall downwardly due to the pressure and the force of gravity. The piston 40 thus strikes the initiator 38 with sufficient force to detonate the explosive in the cord 35, causing an explosion that disintegrates the plug 14, and allows the resulting fragments of the plug 14 to fall to the bottom of the wellbore 10.

Figure 3A:
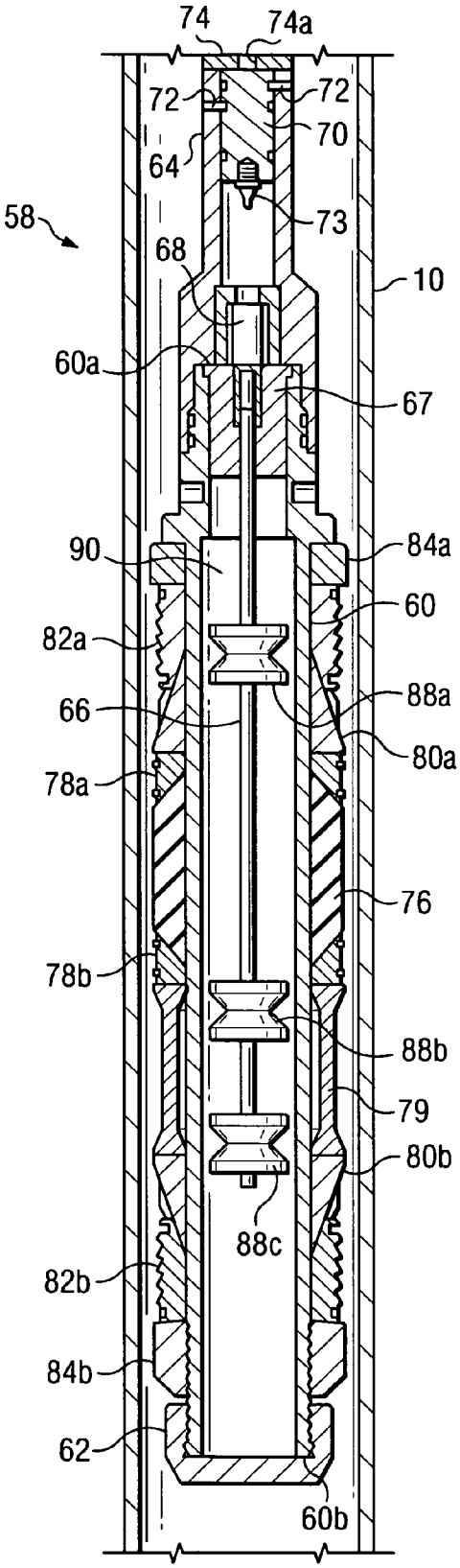
FIG. 3A is a view, similar to that of FIG. 2, but depicting an alternate embodiment of the invention.
Figure 3B:
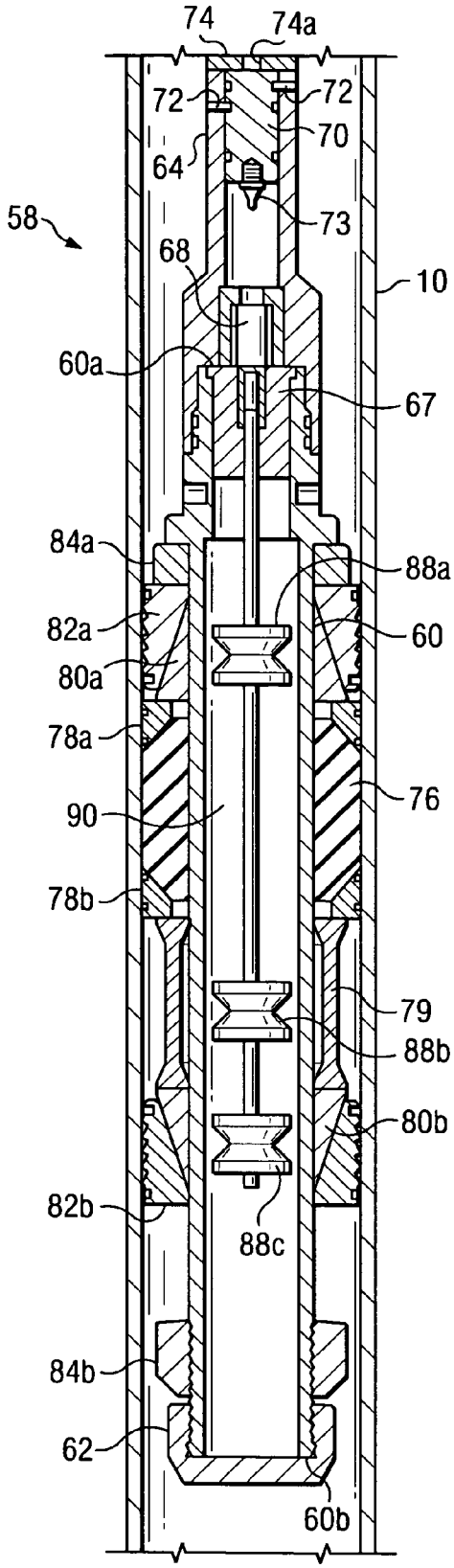
FIG. 3B is a view, similar to that of FIG. 3A, but depicting the embodiment of FIG. 3A in a different position.

Another embodiment of the sealing plug is referred to, in general, by the reference numeral 58 in FIGS. 3A and 3B and is designed to be used with the components depicted in FIG. 1. Thus, the sealing plug, or sealing tool, 58 is disposed in the wellbore 10 at a predetermined depth and is lowered to this position by the string 16, as shown in FIG. 1.

Referring to FIG. 3A, the plug 58 includes a mandrel 60 fabricated from a frangible material, such as a ceramic, and having an upper end 60*a* and a lower end 60*b*, between which a continuous bore extends. A cap 62 extends over the lower end 60*b* of the mandrel 60, and an enlarged end portion of a cylindrical, hollow, neck 64 extends over the upper end 60*a* of the mandrel 60, with the overlapping surfaces of the neck 64 and the mandrel 60 in engagement.

An axially-extending detonation cord 66 extends along the axis of the mandrel 60 and is of a conventional design that contains an explosive, which explodes when detonated. The upper end portion of the cord 66 is disposed in the upper end portion of an axial bore formed through a plug 67 that is located in the upper end 60*a* of the mandrel 60, with the upper end of the plug 67 abutting a shoulder formed in the neck 64.

A detonation initiator, or detonator, 68 is located in a bore extending through the neck 64 and its lower end abuts the upper end of the plug 67. The initiator 68 is conventional and, when activated in a manner to be described, detonates the cord 66, causing the explosive in the cord 66 to explode.

A piston 70 is provided in the neck 64 and is normally retained in the neck 64 by a series of radially-extending shear pins, two of which are shown by the reference numeral 72. The shear pins 72 extend through the wall of the neck 64 and into grooves formed in the outer surface of the piston 70. In the position of the piston 70 shown in FIG. 3A, it extends in the upper portion of the neck 64. A firing pin 73 is mounted on the lower end portion of the piston 70, and, in this position of the piston 70, the firing pin 73 normally extends in a spaced relation to the initiator 68. A cap 74, having a plurality of axially-extending through openings 74*a*, one of which is shown, extends over the upper end portion of the neck 64 and is secured thereto in any conventional manner.

A compression-set, annular sealing element 76, preferably of an elastomer, extends around the mandrel 60 and is axially positioned between two sets of extrusion limiters 78*a* and 78*b*. A relief shoe 79 extends below the extrusion limiter 78*b* and is in the form of a frangible tube that is made to take the setting and function loads, but, when detonation occurs in the manner described below, it will break into many pieces allowing the sealing element 76 to release its energy.

A wedge 80*a* extends between the extrusion limiter 78*a* and slips 82*a*, while a wedge 80*b* extends between the relief shoe 79 and slips 82*b*. Preferably, the wedges 80*a* and 80*b*, and the slips 82*a* and 82*b* are fabricated from a frangible material, such as a ceramic, for reasons to be described.

A pair of axially-spaced ratchet shoes 84*a* and 84*b* extend around the mandrel 60 and abut the corresponding ends of the slips 82*a* and 82*b*. Since the sealing element 76, the extrusion limiters 78*a* and 78*b*, the relief shoe 79, the wedges 80*a* and 80*b*, the slips 82*a* and 82*b*, and the shoes 84*a* and 84*b* are conventional, they will not be described in further detail.

The cord 66 also extends through three axially-spaced explosive tubing cutters 88*a*, 88*b*, and 88*c* that extend within the mandrel 60. The cutters 88*a*-88*c* are conventional, and, as such, are adapted to explode and expand radially outwardly upon detonation of the cord 66. Thus, the profile of each cutter would change from an "hourglass" shape shown in FIGS. 3A and 3B to an "arrow" shape as a result of the expansion. An example of such a cutter is disclosed in U.S. Pat. No. 6,016,753, the disclosure of which is incorporated herein by reference in its entirety.

In the non-set position of the plug 58 shown in FIG. 3A, the cutter 88*a* is vertically aligned with the upper end portion of the wedge 80*a*, the cutter 88*b* is vertically aligned with the lower end portion of the sealing element 76, and the cutter 88*c* is vertically aligned with the upper end portion of the wedge 80*b*.

When the well is not in production, the above-mentioned closure device associated with the wellhead 22 (FIG. 1) is set to prevent any flow of production fluid from the formation F and through the casing 12 to the rig 18, as described above in connection with the previous embodiment. However, if the wellhead closure device must be removed for repair, replacement, or the like, the plug 58 is lowered, via the string 16, to a desired depth in the casing 12. During this lowering of the plug 58, it is in its non-set position shown in FIG. 3A, and after it reaches the desired depth, it is moved to its set position shown in FIG. 3B in the following manner.

A setting tool (not shown), or the like, is utilized to drive the slips 82*b* upwardly relative to the mandrel 60 and over the wedge 80*b* to expand the slips 82*b* radially outwardly into a locking engagement with the inner wall of the casing 12. This upward movement of the slips 82*b* also drives the wedge 80*b* and the extrusion limiter 78*b* upwardly to place a compressive force on the sealing element 76 causing it to expand radially outwardly into a sealing engagement with the inner wall. The sealing element 76 also moves upwardly which, in turn, drives the extrusion limiter 78*a* and the wedge 80*a* upwardly. This upward movement of the wedge 80*a* drives the slips 82*a* radially outwardly into a locking engagement with the inner wall of the casing 12. Thus, the slips 82*a* and 82*b* lock the tool 58 in its set position of FIG. 3B, and the sealing element 76 seals against any flow of production fluid from the formation F through the casing 12.

In this set position of the tool 58 shown in FIG. 3B, the cutter 88*a* is vertically aligned with the wedge 80*a* and the slips 82*a*, the cutter 88*b* is vertically aligned with the center of the relief shoe 79, and the cutter 88*c* is vertically aligned with the wedge 80*b* and the slips 82*b*. Thus, when exploded in the manner discussed below, the cutters 88*a*, 88*b*, and 88*c* expand radially outward into the mandrel 60 and cut through the mandrel 60, the wedges 80*a* and 80*b*, and the slips 82*a* and 82*b* to disintegrate the tool 58.

When it is desired to recap the well by the closure device associated with the wellhead 22 (FIG. 1), the plug 58 is removed by introducing fluid, such as water, from a source at the rig 18 into the upper end of the casing 12, so that it passes through the openings 74*a* in the cap 74, thus creating a pressure, or force, against the piston 70. When this force reaches a certain magnitude, the shear pins 72 break to allow the piston 70 to fall downwardly due to the pressure and the force of gravity.

The firing pin 73 thus strikes the initiator 68 with sufficient force to detonate the explosive in the cord 66, which, in turn, detonates the cutters 88*a*, 88*b*, and 88*c*. The cutter 88*a* expands outwardly into the mandrel 60, as discussed above, and cuts through the mandrel 60, the wedge 80*a*, and the slips 82*a*. The cutter 88*b* expands radially outwardly into the mandrel 60 and cuts through the mandrel 60 and the relief shoe 79. Similarly, the cutter 88*c* expands radially outwardly into the mandrel 60 and cuts through the mandrel 60, the wedge 80*b*, and the slips 82*b*. Thus, the plug 58 is disintegrated, and the resulting fragments of the plug 58 fall to the bottom of the wellbore 10.

The above-mentioned closure device associated with the wellhead 22 (FIG. 1) is then reinstalled over the wellhead 22 and set to prevent any flow of production fluid from the formation F and through the casing 12 to the rig 18.

Thus, the plug 58 can be placed in the wellbore 10 and activated to seal off the flow of production fluid as discussed above and yet can be removed in a relatively simple and inexpensive manner.

VARIATIONS

It is understood that variations may be made in the foregoing without departing from the scope of the invention. Non-limiting examples of these variations are as follows:

The downhole tools 14 and 58 can be used in other sealing applications other than the ones described above such as zonal isolation for fracturing operations, temporary well abandonment, etc.

The number of slips and sealing elements associated with each plug 14 and 58 can be varied.

The wellbore 10 could be an openhole completion, sans the casing 12, in which case the wellbore 10 would be sealed by the plugs 14 and 58.

The caps 44 and 62, which are for the purpose of preventing the ingress of debris, etc., into the wellbore 10, can be eliminated.

Rather than use the pistons 40 and 70 and the firing pins 43 and 73, respectively, a slick line with a power pack at its end could be lowered into the well until it contacts the plugs 14 and 58, respectively, with the contact detonating the explosive.

The compression-set sealing elements 48 and 76 can be tension-set or inflatable.

In the embodiment of FIGS. 3A and 3B, a protective tube can be provided that is disposed in the mandrel 60 and receives at least a portion of the cord 66.

Different type cutters, other than the cutters 88*a*-88*c*, can be used.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A downhole tool for sealing a casing or a wellbore, comprising:

a mandrel;

at least one device supported by the mandrel and adapted to move into engagement with the casing or wellbore;

at least one explosive cutter supported by the mandrel and aligned with the device; and a detonation system for exploding the cutter to cut the mandrel and the device and release the engagement wherein:

the device is supported on the outside of the mandrel;

the cutter is supported on the inside of the mandrel; and when the cutter explodes, it expands radially outwardly into the mandrel and the device and cuts same.

2. The tool of claim 1 wherein there is one cutter for each device and each cutter cuts its corresponding device.

3. The tool of claim 1 wherein there are at least two devices, at least one of which is slips and at least one of which is a sealing element.

4. The tool of claim 3 wherein there are two sets of slips and one sealing element.

5. The tool of claim 3 wherein the mandrel and the slips are frangible and disintegrate in response to the cutting.

6. The tool of claim 5 further comprising a mechanism to apply a compressive force to the slips to expand them into the engagement with the casing or wellbore before they are cut.

7. The tool of claim 1 wherein the cutter comprises a detonation cord.

8. The tool of claim 7 wherein at least part of the detonation cord is wound around a liner inside of the mandrel.

9. A downhole tool for sealing a casing or a wellbore, comprising:

a mandrel;

at least one device supported by the mandrel and adapted to move into engagement with the casing or wellbore;

at least one explosive cutter supported by the mandrel and aligned with the device; and a detonation system for exploding the cutter to cut the mandrel and the device and release the engagement, wherein there are at least two devices, at least one of which is slips and at least one of which is a sealing element, wherein the mandrel and the slips are frangible and disintegrate in response to the cutting; and further comprising a mechanism to apply a compressive force to the slips to expand them into the engagement with the casing or wellbore before they are cut wherein:

there is a cutter for each set of slips; and each cutter is aligned with its corresponding device when the devices are in engagement with the casing or the wellbore, so that, when the cutter explodes, it expands radially outwardly into the mandrel and into the corresponding device and cuts same.

10. A downhole tool for sealing a casing or a wellbore, comprising:

a mandrel;

at least one device supported by the mandrel and adapted to move into engagement with the casing or wellbore;

at least one explosive cutter supported by the mandrel and aligned with the device; and a detonation system for exploding the cutter to cut the mandrel and the device and release the engagement, wherein the detonation system comprises:

a detonation cord supported by the mandrel; and a detonator supported by the mandrel for detonating the cord which explodes the cutter.

11. The tool of claim 10 wherein the detonation system further comprises an element responsive to a predetermined fluid pressure acting on the tool for activating the detonator.

12. The tool of claim 11 wherein the element is a piston slidably disposed in the mandrel and adapted to respond to the predetermined fluid pressure to slide into engagement with the detonator.

13. The tool of claim 10 wherein at least part of the detonation cord is wound around a liner inside of the mandrel.

14. A method for sealing a casing or a wellbore, comprising the steps of:

providing a mandrel to support at least one device and support at least one explosive cutter that is aligned with the device;

lowering the mandrel into the easing or the wellbore;

expanding the device into engagement with the casing or wellbore; and exploding the cutter to cut the mandrel and the device and release the engagement, wherein the step of exploding comprises detonating a detonation cord which explodes and expands the cutter to cut the mandrel and the device.

15. The method of claim 14 wherein there are at least two devices, at least one of which is slips and one of which is a sealing element.

16. The method of claim 15 wherein there are two sets of slips and one sealing element.

17. The method of claim 15 wherein the mandrel and the slips are frangible and disintegrate in response to the cutting.

18. The method of claim 17 wherein the step of expanding comprises applying a compressive force to the sealing element to expand it into engagement with the casing or wellbore.

19. The method of claim 18 wherein:

there is a cutter for each device; and each cutter is aligned with its corresponding device when the devices are in engagement with the casing or the wellbore, so that the explosion causes the cutter to expand radially outwardly into the mandrel and into the corresponding device to cut same.

20. The method of claim 14 wherein the step of exploding further comprises responding to a predetermined fluid pressure and activating a detonator which detonates the cord.

21. The method of claim 14 wherein at least part of the detonation cord is wound around a liner inside of the mandrel.

22. A method for sealing a casing or a wellbore, comprising the steps of:

providing a mandrel to support at least one device and support at least one explosive cutter that is aligned with the device;

lowering the mandrel into the casing or the wellbore;

expanding the device into engagement with the casing or wellbore; and exploding the cutter to cut the mandrel and the device and release the engagement, wherein:

the device is supported on the outside of the mandrel;

the cutter is supported on the inside of the mandrel; and the step of exploding causes the cutter to expand radially outwardly into the mandrel and the device to cut same.

23. The method of claim 22 wherein there is one cutter for each device and each cutter cuts its corresponding device.

* * * * *